United States Patent [19]

Davis et al.

[11] 4,236,483

[45] Dec. 2, 1980

[54] METERING ROLL WITH FIXED SLIDERS

[75] Inventors: Austin E. Davis; Raymond G. Cormier, both of Nashua; Leo O. Lutz, Hollis; Henry T. Pauk; Harry E. Lones, both of Nashua, all of N.H.

[73] Assignee: Nashua Corporation, Nashua, N.H.

[21] Appl. No.: 56,128

[22] Filed: Jul. 9, 1979

[51] Int. Cl.[3] ..... B05C 1/08

[52] U.S. Cl. ..... 118/647; 101/363; 101/350; 118/262; 118/661; 355/10; 430/117

[58] Field of Search ..... 118/261, 262, 661, 647; 101/350, 363, 207, 208; 358/10; 427/15, 16, 17; 430/117

[56] References Cited

U.S. PATENT DOCUMENTS

| | | | |
|---|---|---|---|
| 2,644,424 | 7/1953 | Bixby | 118/262 X |
| 3,245,377 | 4/1966 | Gettel | 118/119 |
| 3,830,199 | 8/1974 | Saito et al. | 118/661 |
| 3,907,423 | 9/1975 | Hayashi et al. | 355/10 |
| 3,957,016 | 5/1976 | Yamada | 427/15 X |
| 4,023,899 | 5/1977 | Hayashi et al. | 427/15 X |
| 4,052,959 | 10/1977 | Hayashi et al. | 118/262 X |
| 4,135,475 | 1/1979 | Bomers | 118/262 X |

FOREIGN PATENT DOCUMENTS

| | | | |
|---|---|---|---|
| 269855 | 11/1964 | Australia | 355/10 |

*Primary Examiner*—Shrive P. Beck
*Attorney, Agent, or Firm*—Kenway & Jenney

[57] ABSTRACT

A metering roll, employed between the developing station and the transfer station of a photocopier which uses a liquid toner, controls the thickness of the liquid on the photosensitive drum surface when it is presented to the transfer station. Shoe-like elements fixed between the drum and roll maintain the central metering portion in a substantially constant spaced apart relationship to the photosensitive drum surface and thereby tend to limit and control the thickness of developer on the drum surface at the transfer station. One surface of the element substantially conforms to an arc of the drum surface and another surface defines a hole through which a portion of the metering roll passes.

6 Claims, 4 Drawing Figures

METERING ROLL WITH FIXED SLIDERS

BACKGROUND OF THE INVENTION

The invention relates generally to photocopiers employing liquid toner developer, and particularly to apparatus for removing excess liquid developer from a photosensitive drum surface before transfer of the image to a copy material.

In a photocopier employing a rotating photosensitive drum surface, the drum surface is electrically charged and then exposed to an original light pattern to form a latent electrostatic image on the surface. The latent image is developed, for example by contacting a liquid developer to the image, and the developed image is transferred onto copy material by a transfer process. The drum is thereafter cleaned and used again.

In photocopiers employing liquid toner development, it is necessary prior to the transfer step to remove excess liquid developer remaining on the drum after development. The development process is not precise, and excess developer remaining on the drum surface can cause a blurry or fuzzy image on the transfer material and can excessively wet the transfer material so that drying would either take longer or be incomplete.

Among the devices used in the past to remove excess liquid from a wet surface have been rollers of one form or another. For example, in the printing and paper industry, it was common to rest a roller directly on the wet surface to remove excess liquid. (See for example U.S. Pat. No. 3,245,377, to Gettel). In those applications wherein the roller could not be placed directly upon the surface, various methods and apparatus for maintaining the roller spaced above the surface were employed. For example, the roller axis or shaft could be fixed to the apparatus frame (for example Australian Pat. No. 269855), or the roller could be supported by roller bearings which ride on, and are driven by, the surface being controlled. Each of these apparatus configurations was available prior to the introduction of the first plain paper liquid copiers, and apparatus employing the roller bearing method and apparatus described earlier were adopted almost simultaneously by at least two competing manufacturers for their commercial photocopiers. The manufacturers merely differed with respect to the direction of rotation of the operational roller, the different rotation directions having also been considered and disclosed previously in connection with related operating systems.

In each apparatus employing roller bearings to space the roller from the drum surface, the roller rotates with respect to the roller bearings. It is therefore imperative to provide bushings, bearings, or the equivalent structure between the two differentially rotating parts. The adjustment, lubrication, and most importantly, the sealing of these roller bearings require careful attention, consideration, and control, and effectively increase the cost of the apparatus. Further, the commercial apparatus employing the roller bearing systems often employed hardened drum edges, for example, anodized aluminum, to further reduce wear from the rolling friction of the roller bearings on the drum.

In U.S. application Ser. No. 40,901, to Davis, filed May 21, 1979 and assigned to the same Assignee as the present application, there was disclosed a metering roll with distance control portions rigidly secured to its ends. The distance control portions had exterior dimensions selected to keep the central metering portion of the roll a fixed distance from the central drum surface. The surfaces of the distance control portions were in sliding frictional contact only with the surface of the drum against which they were biased.

That metering roll, however, still required a careful axial arrangement of multi-level surfaces to provide the required gap between the metering portion of the roll and the drum surface. It required careful dimensional control of the outer surface of the distance control portions, and if they were separately made, as is likely, careful coaxial alignment of the distance control portion and the metering portion when they are secured together.

Accordingly, it is an object of this invention to provide a reliable, relatively inexpensive metering apparatus that does not require the precise coaxial alignment of earlier metering rolls. A further object of the invention is to provide a metering apparatus that is easier and less expensive to manufacture, that has low wear characteristics, that has a long lifetime, and that is substantially unaffected by the liquid toner developer solutions.

SUMMARY OF THE INVENTION

The invention relates to copying apparatus having a rotatable drum with a reusable photosensitive surface. The apparatus further has a developing station where liquid toner is applied to the drum surface, and a transfer station.

The invention features a metering apparatus for controlling the thickness of the liquid toner on the drum prior to the transfer station and including a metering roll biased toward the drum and maintained a distance from it. An element is fixed between the drum and the roll, secured in an operative fixed position, and has a surface against which the drum slides and another surface against which the metering roll slides, the distance between the surfaces controlling the minimum distance between the drum photosensitive surface and metering roll.

In a preferred embodiment the element is a body having a hole, through which a portion of the metering roll extends and against which it rotates in sliding contact, and also having a surface conforming to an arc of the photosensitive drum surface, against which it is also in sliding contact. In the event of the metering roll being pivoted to an inoperative position away from the drum, the embodiment can include the body having a surface for engaging a stop element, so that the body will not rotate in the inoperative position.

BRIEF DESCRIPTION OF THE DRAWINGS

Other objects, features and advantages of the invention will appear from the following description of a preferred embodiment and the drawings, in which.

DESCRIPTION OF A PREFERRED EMBODIMENT

Figure 1:
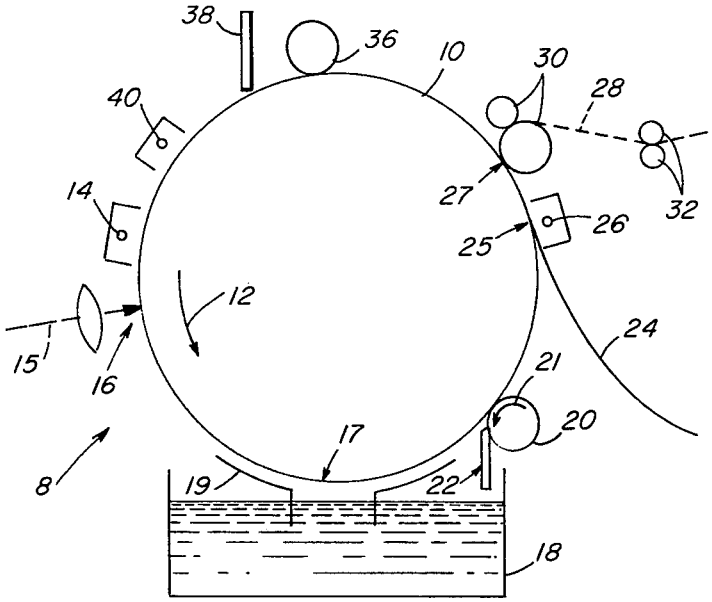
FIG. 1 is a schematic sectional view of a photocopier in which the present invention is incorporated.
Figure 4:
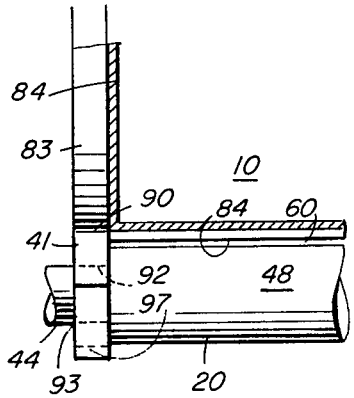
FIG. 4 is a sectional view along the lines 4—4 of the apparatus shown in FIG. 3.

Referring to FIG. 1, a typical photocopier 8 in which the present invention can be employed has a photosensitive drum 10, preferably one having a photosensitive selenium layer deposited on an aluminum substrate, rotating in the counterclockwise direction as indicated by arrow 12. A charge corona 14 charges the drum 10 to about +1000 volts D.C. The charged drum is exposed to an image 15 at an exposure station 16. The image is focused on the drum photosensitive surface and thereupon the charge on the drum surface forms an electrostatic latent image comprising a pattern of electrical charges. The electrostatic latent image on the drum surface is brought to a development station 17 where a liquid developer having, in the illustrated embodiment, a negatively charged toner, contacts the electrostatic image to develop the image. The development station includes a developer tank 18 and a development electrode 19. Developer is introduced between the development electrode and the drum surface to develop the electrostatic image. The drum surface, now wetted and carrying the developed image, travels past a metering roll 20 rotating also in the counterclockwise direction as indicated by arrow 21, which controls and limits the thickness of the liquid on the drum surface. A wiper 22 engages a central metering portion 23 (FIG. 2) of the metering roll 20, and removes the excess liquid that accumulates on the metering roll. A copy material 24, which is preferably sheet material, is fed to the drum surface at a transfer station 25. In this illustrated embodiment, a positive charge from a transfer corona 26 is applied to the back side of the copy material 24, causing the transfer of toner particles from the developed image on the drum's surface to the copy material. The copy material is then removed from the drum surface at 27 and follows a path 28 dictated by rollers 30 and 32.

After transfer, there remains on the drum a residue of liquid developer. The drum is continuously cleaned of this remaining residue by a surface contacting cleaning roller 36 and a cleaning blade 38. Finally, the drum surface is electrically neutralized prior to the next charging step by a high A.C. neutralizing charge from a discharge corona 40.

When the drum surface passes the surface area defined by the development electrode 19, it has on its surface the developed image plus an excess amount of liquid developer. If the transfer material 24 were brought into contact with the drum when it had the excess developer, the transfer sheet, if it were for example paper, would be excessively wetted and would be difficult to properly dry. In addition, the resolution of the transferred image could be reduced by an excessive amount of liquid on the drum. According to the preferred embodiment, the metering roll 20 is provided.

Figure 2:
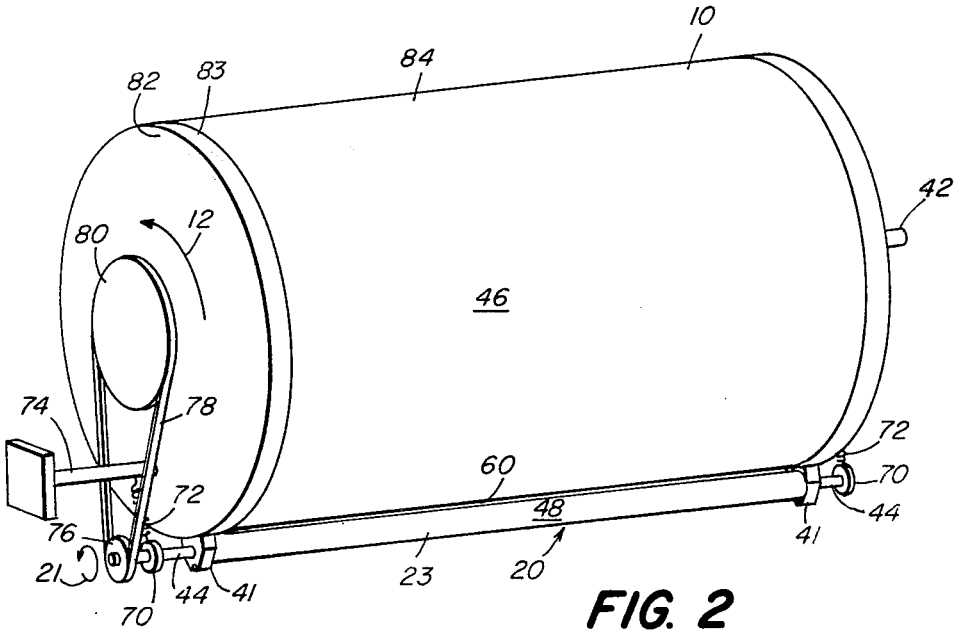
FIG. 2 is a perspective view of the drum and a metering roll apparatus according to the invention.

Referring to FIG. 2, the structural relationship of the drum 10, the metering roll 20, and sliders 41, separating the drum and the roll, is shown. Other elements of the photocopier 8 have been omitted for the sake of clarity. And the relative spacing and sizes of the metering roll 20 and the sliders 41 have been exaggerated to enable a clearer understanding of the invention.

The drum 10 is mounted on a shaft 42 about which it is rotated in the direction shown by the arrow 12. The metering roll 20 is mounted by shaft members 44 extending from the central portion about whose axes it is rotated in the direction shown by the arrow 21. The surface 46 of the drum 10 and the surface 48 of the metering roll 20, accordingly, are moving in opposite directions at the location of their closest approach. The surfaces 46 and 48 are separated from each other by a gap 60, however, because of the presence of the sliders 41.

The metering roll 20 has the central metering portion 23 and shaft members 44, which, in the illustrated embodiment, are different portions of a single cylinder of circular cross section, preferably made of aluminum and having an anodized surface to provide a hard durable surface. The metering roll shaft 44 extends through spring biased bushings or bearings 70. The bushings or bearings 70 are connected by respective springs 72 to support mountings 74 secured to the frame (not shown) of the photocopier apparatus. The springs 72 urge the metering roll 20 toward the drum 10. The illustrated metering roll shaft 44 has a drive gear 76 attached thereto. Gear 76 is driven by a chain 78 connected to a drive gear 80 mounted on the drum shaft 42. This drive structure causes metering roll 20 to rotate whenever the drum 10 is rotating, and in the same angular direction as the drum (compare arrows 12 and 21).

The surface 46 of the drum 10 in the illustrated embodiment has a substrate 82 of aluminum which is uncovered and visible at each edge 83 of the peripheral surface for a distance of about 0.5 inch. The central, photosensitive, portion 84 of the drum surface has a layer of photosensitive selenium approximately 0.0015 inch thick on the aluminum substrate. A typical width for the central portion 84 would be 8.5 inches.

In the embodiment illustrated, the slider spacer 41 has a shoe-like rigid body. The slider includes an exterior arcuate drum contact surface 90 substantially conforming to an arc of the drum edge 83, for sliding, frictional contact with the drum edge surface. The drum contact surface 90 is designed to have a radius of curvature no greater than that of the drum surface it contacts. Consequently, it has edges 94 and 95 always in firm contact with the surface of the drum edge 83, providing a contact position that is always stable.

The slider element 41 also includes an interior surface 92 defining a hole 93 through which the stepped down shaft 44 of the metering roll 20 extends, so that the shaft is in a sliding relationship with that surface 92 of the slider 41. The slider element 41 also has a surface forming a notch 97 on its side opposite the drum 10. A stop rod 98 is shown near the notch 97 directly in the path the slider element 41 will take as the roller 20 is pivoted away from the drum 10, as is done when the drum must be removed for cleaning or maintenance. The rod 98 is attached to the frame of the photocopier in a conventional manner not shown in the drawing.

The sliders 41 are preferably formed from a polyolefin such as the one sold under the trademark "Pennlon" by Dixon Corporation, Bristol, Rhode Island. However other materials such as Teflon, vinyl acetals, olefins, Rulon, etc., that have the necessary lubricity and wear characteristics can also be employed. In particular, the material comprising the surfaces of the strips 41 should be self-lubricating to reduce sliding friction with drum 10, and roll 20, and should be hard and tough to provide long life.

In operation, the metering roll 20 removes the excess liquid remaining on the photosensitive drum surface portion 84 after it passes the development station 17, that is, the step of contacting liquid developer to the drum at the development electrode. The gap 60 between the metering portion 23 and the drum surface is one of the parameters, as is well known in the art, which sets the thickness of the liquid developer presented to the transfer station 25.

Thus, according to the invention, the metering roll 20, driven by the drum shaft 42, rotates in the same angular direction as the drum so that its surface 48 is moving opposite the drum surface 46 at the gap 60. In the illustrated embodiment, the drum 10 can rotate, for example, at 34 rpm and the metering roll 20 can rotate, for example, at 396 rpm.

Figure 3:
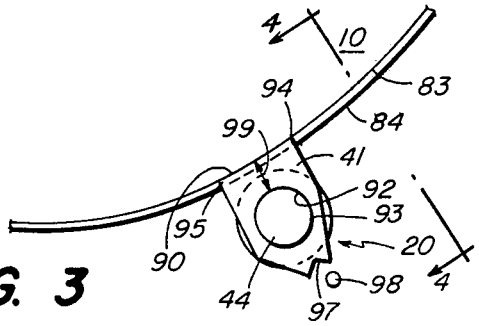
FIG. 3 is a detailed elevational, sectional view of one end of the metering roll apparatus shown in FIG. 2.

During this operation of the photocopier, the arcuate surface 90 of the shoe-like slider 41 is in sliding contact with the surface of the drum edge 83, and the shaft 44 of the metering roll 20 is in sliding, rotational contact with the surface 92 of the spacer that defines the hole 93 through which the shaft extends. The diameter of the hole 93 is slightly greater than that of the shaft 44. The diameter of the shaft, for example, in the illustrated embodiment is 0.754 inch, and the diameter of the hole 93 is 0.004 inch larger. The gap 60 between the photosensitive surface 84 of the drum 10 and the surface 48 of the metering roll 20 is controlled by the shortest distance between the slider surface 92 of the hole 93 and the drum contacting slider surface 90. The dimension of this distance in the embodiment, shown by the line designated 99 in FIG. 3, is 0.175 inch. Since the slider surface 90 slides on the aluminum substrate edge 83, and the selenium surface 84 is about 0.0015 inch in height, with a metering roll central portion 23 of diameter of 1.098 inch, the gap 60 between surfaces 84 and 48 would be 0.0015 inch.

When the metering roll 20 is pivoted away from the drum 10, the notch 97 meets the stop rod 98 mounted on the photocopier frame. The spacer 41 is therefore prevented from rotating around the roller shaft 44 and interfering with removal or insertion of the drum 10.

Other modifications of the disclosed embodiment such as varying the configurations of the sliding surfaces of the slider are contemplated and would be within the scope of the invention.

SUMMARY OF THE ADVANTAGES OF THE INVENTION AND NONOBVIOUSNESS

The metering roll apparatus according to the invention advantageously provides for a simple construction of the metering roll. It provides also for a simpler and more controllable structure for spacing the roll from the drum photosensitive surface.

Some prior art photocopy apparatus, for example that described in U.S. Pat. Nos. 3,957,016, 3,907,423, 4,023,899, and 4,052,959, appear to contemplate and require roller bearings on the ends of the roller in order to space the roller with respect to the drum. This is exactly the kind of structure which has been employed in connection with coating or printing equipment. Also, in the prior art copier systems the roller bearings are driven by the copier drum member in order to maintain a rotating, non-sliding, friction drive relationship between the drum and the bearings, and, according to the prior art, to reduce or minimize drum wear. Nevertheless, anodized hardened edge portions were considered necessary and were employed on the drum to further minimize the effects of wear.

The use of roller bearings is clearly described by earlier references which employ roller bearings to accomplish and achieve substantially the same effect. The use of those roller bearings in connection with photocopier rollers is a natural extension of the prior art systems.

The metering roll disclosed in Davis, U.S. Ser. No. 40,901, filed May 21, 1979 was itself a significant simplification in the structure of the metering roll, namely providing the distance control portions fixed at either end of the roll to be in sliding frictional contact with the drum. Because of this the metering roll had all its elements rotationally fixed, and bearings employed in prior art rollers were eliminated. Conveniently, the distance control end pieces could be detachably mounted on the central metering portion so that the distance control end pieces could be manufactured separately and thus easily be replaced since they were more likely to wear than the central portion of the roll.

The metering roll apparatus for this invention goes significantly further and eliminates the need for having concentric distance control elements secured to the metering roll itself. With this new structure, the metering roll now could be, if desired, reduced to a simple cylinder of a constant circular cross section for its central portion, and ends that are stepped down. Stepped down ends are relatively easy to accomplish, since they may be made along with the central metering portion of the roll, in a single lathe operation. The distance control elements are however separate elements that are easily placed in, and removed from, the apparatus, to provide gap control.

The resulting elimination of the problems of coaxially aligning the distance control elements and the central metering portion, and the elimination of the problem of concentricity of the distance control portions provide significant advantages over prior art systems. And according to the present invention, the gap between the drum and metering roll is determined by the relatively easily maintained dimension of the thickness of a stationary distance control shoe or other fixed element.

Materials suitable for the sliding frictional contact contemplated by this invention may be dimensionally sensitive to heat, to the developing liquid, and to other parameters of the copier operating environment. The effects are, it appears, easier to control when the material is in the form of the simpler elements of the present invention, because a less complicated and stationary structure is involved.

Also since the distance control elements are fixed between the oppositely rotating drum and metering roll, the frictional effect is reduced. When, as in the previous application, the drum and distance control portions rotate against each other, their speeds add and provide a higher relative difference in velocity. In the present invention, the elements are fixed, and one surface is in contact with one rotating element, while the opposite surface is in contact with the other rotating element. The speeds of the rotating elements are not therefore cumulative in their effect.

In the embodiment described above, the shoe-like body possesses two surfaces in sliding contact with the drum and metering roll respectively. One of the surfaces defines a hole through which the metering roller extends. The other surface of the body, the arcuate surface, provides a large area of contact between the body and the drum. Nonuniform changes in the dimensions of the body are less likely to affect a large area of contact, and so dimensional stability is more easily attained.

Many variations of the shape of fixed distance control elements would have little effect on these advantages. And other additions, subtractions, deletions and other modifications of the disclosed embodiments will be obvious to those skilled in the art and are within the scope of the following claims.

What is claimed is:

1. In a copying apparatus having a rotating drum having a reusable photosensitive surface, a developing station for contacting liquid toner to said drum surface to develop an electrostatic image, and a transfer station for transferring said developed image to a transfer material, apparatus for controlling the thickness of said liquid toner on said drum prior to said transfer station, comprising:

a metering roll, means for biasing said metering roll toward said drum, and means for controlling the minimum distance from said drum photosensitive surface to said metering roll comprising:

a positionably fixable element fixed against rotation about an axis parallel to the axis of rotation of said rotating drum, means for securing said element in an operative fixed position between said drum and said metering roll, said element in said operative position having a first non-rotating surface against which said rotating drum surface can rotate in sliding frictional contact and a second non-rotating surface against which said metering roll can rotate in sliding, frictional contact, the distance between said first and second surfaces controlling the minimum distance between said roll and said drum photosensitive surface.

2. The apparatus of claim 1 in which said first surface of said element conforms substantially to an arc of the peripheral surface of said drum.

3. The apparatus of claim 2 in which said second surface defines a hole through which an end portion of said metering roll passes in said sliding frictional contact.

4. In a copying apparatus having a rotating drum having a reusable photosensitive surface, a developing station for contacting liquid toner to said drum surface to develop an electrostatic image, and a transfer station for transferring said developed image to a transfer material;

apparatus for controlling the thickness of said liquid toner on said drum prior to said transfer station, comprising:

a metering roll, means for biasing said metering roll toward said drum, and means for controlling the minimum distance from said drum surface to said metering roll comprising:

a rigid body having:

a first, interior surface defining a hole through which an end of said metering roll extends in a sliding, frictional contact with said first surface, and a second, exterior surface, fixed relative to said first surface, said second surface forming an arc substantially conforming to an arc of said drum surface, said drum surface being in sliding, frictional contact with said second surface, the distance between said first and second surfaces controlling the distance between said drum surface and said metering roll.

5. The copying apparatus as claimed in claim 4, further comprising a fixed stop element spaced from said distance controlling means, said rigid body having a third surface for contacting said fixed stop element, whereby when said metering roll is privoted from a position adjacent said drum, said third surface engages said fixed stop element and rotation of said body about said metering roll is prevented.

6. The copying apparatus as claimed in claim 4 wherein said arc of said second, exterior surface has a radius of curvature no greater than the radius of curvature of said drum surface.

* * * * *